US006144147A

United States Patent [19]

Heine et al.

[11] Patent Number: 6,144,147

[45] Date of Patent: Nov. 7, 2000

[54] SHADOW MASK HAVING AN INSULATING LAYER AND A PROCESS FOR THE PRODUCTION OF THE SAME

[75] Inventors: Günter Heine; Bernhard Schonert; Peter Neumann; Ulrich Schülke; Albrecht Uhlig, all of Berlin, Germany

[73] Assignee: Samsung Display Devices Co., Ltd., Kyunki-do, Rep. of Korea

[21] Appl. No.: 08/990,614

[22] Filed: Dec. 15, 1997

[30] Foreign Application Priority Data

Dec. 20, 1996 [DE] Germany ..... 196 54 613

[51] Int. Cl.[7] ..... H01J 29/80; H01J 9/12; H01J 9/236

[52] U.S. Cl. ..... 313/402; 313/407; 313/408; 445/37; 445/47

[58] Field of Search ..... 313/461, 402, 313/403, 407, 408, 477 R; 427/126.2, 126.3, 376.5; 445/37, 47

[56] References Cited

U.S. PATENT DOCUMENTS

| | | | |
|---|---|---|---|
| 3,887,828 | 6/1975 | Bathelt et al. . | |
| 4,629,932 | 12/1986 | Tokita . | |
| 4,734,615 | 3/1988 | Koike et al. | 313/402 |
| 4,784,627 | 11/1988 | Van Uden . | |
| 4,801,842 | 1/1989 | Compen . | |
| 4,884,004 | 11/1989 | Deal et al. . | |
| 5,017,830 | 5/1991 | Koike . | |
| 5,256,932 | 10/1993 | Watanabe et al. . | |
| 5,733,163 | 3/1998 | Kim et al. | 445/47 |
| 5,841,223 | 11/1998 | Muramatsu et al. | 313/402 |

FOREIGN PATENT DOCUMENTS

| | | |
|---|---|---|
| 0403219 | 12/1990 | European Pat. Off. . |
| 3617908 | 12/1986 | Germany . |
| 19526166 | 6/1996 | Germany . |

OTHER PUBLICATIONS

Engl. abstract of "Color Picture Tube", Sachiko, et al. (JP 07182986 A) pub. Jul. 21, 1995. Patent Abstracts of Japan (1995).

Engl. abstract of "Color Picture Tube and Manufacture Thereof" Sachiko, et al. (JP 07254373 A) pub. Oct. 3, 1995. Patent Abstracts of Japan (1995).

Engl. abstract of "Color Cathode Ray Tube and its Manufacture" Hirasawa (JP 07182986 A) pub. Feb. 16, 1990. Patent Abstracts of Japan E–922 vol. 14 No. 210 (Apr. 27, 1990.

Engl. abstract of "Color Picture Tube", Kida (JP 62–206747 A) pub. Sep. 11, 1987 Patent Abstracts of Japan E–585 vol.12/No.63 Feb. 25, 1988.

Engl. abstract of "Color Picture Tube", Kita (JP 62229737 A) pub. Oct. 8, 1987. Patent Abstracts of Japan E–594 vol.12/No.99 Mar. 31, 1988.

Engl. abstract of "Color Image Receiving Tube" Koike (JP 2119032 A) pub. May 7, 1990. Patent Abstracts of Japan E–955 vol.14/No.344 Jul. 25, 1990.

*Primary Examiner*—Nimeshkumar D. Patel
*Assistant Examiner*—Mack Haynes
*Attorney, Agent, or Firm*—Leydig, Voit & Mayer, Ltd.

[57] ABSTRACT

A shadow mask for a color picture tube a thermal includes insulating layer preventing heat transfer to an apertured shadow mask. The side of the mask directed toward the cathode of the color picture tube is coated with a heat-insulating layer including particles having a porous structure. The pores may contain heavy metals or heavy metal compounds so that electron reflection and absorption occurs directly within the layer. The resulting heat is transferred to the interior of the picture tube instead of to the mask.

27 Claims, 1 Drawing Sheet

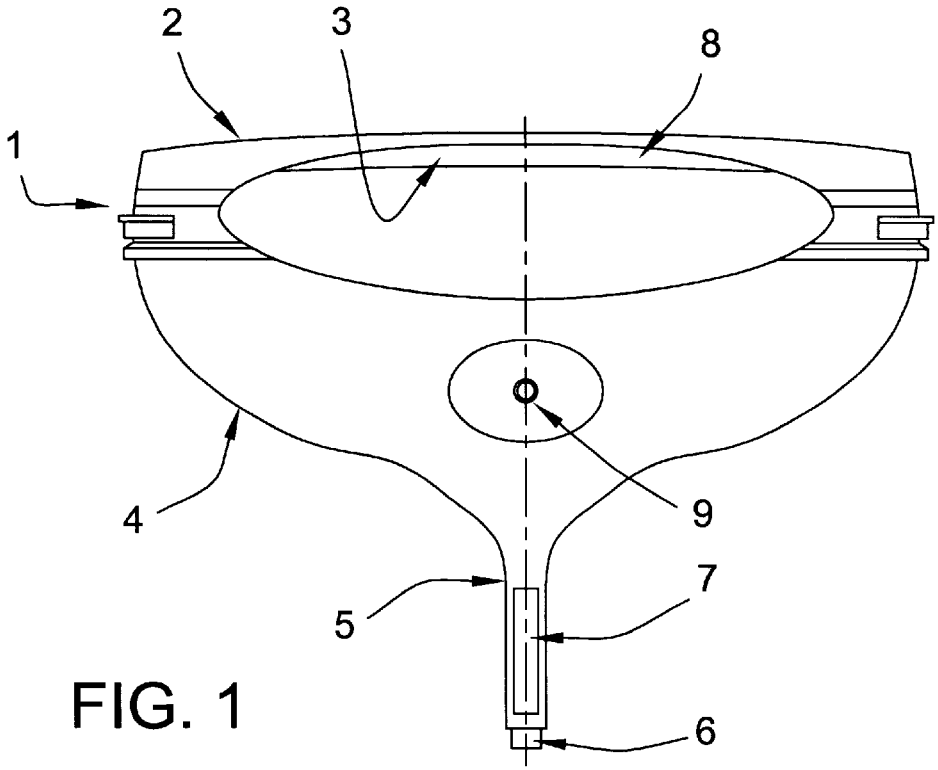
FIG. 1
FIG. 2
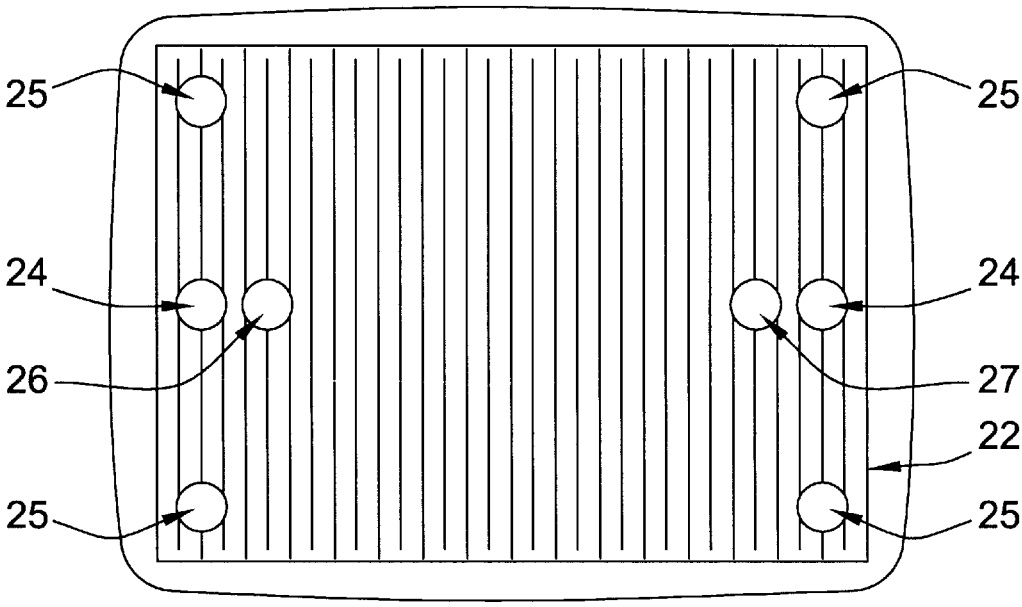

SHADOW MASK HAVING AN INSULATING LAYER AND A PROCESS FOR THE PRODUCTION OF THE SAME

TECHNICAL FIELD

The invention relates to a shadow mask for color picture tubes, and to a process for the production of a shadow mask.

BACKGROUND OF THE INVENTION

In a color picture tube having a shadow mask, the mask is arranged in direct proximity to the interior surface of the screen of a picture tube. Because luminescent segments are produced on the interior surface of the screen, the geometry of the shadow mask typically conforms to the pattern of the luminescent segments when the color picture tube is in operation. Maximum impact accuracy of the electron beams on the luminescent segments is achieved when the aperture geometry of the shadow mask matches the distribution of the luminescent segments on the interior surface of the screen at a predetermined operating temperature. However, only a small portion of the emitted electrons pass through the mask and strike the luminescent segments. The majority of the electrons strike the mask directly. Consequently, the mask can heat up to 80° C., thereby resulting in a change in mask geometry.

This change in mask geometry can produce a doming effect in the mask. The aperture geometry of the shadow mask no longer conforms to the distribution of the luminescent segments, resulting in imprecise electron strikes. The color rendering quality of the screen can be affected.

With high contrast pictures, different areas of the mask can be heated to different levels, thus giving rise to partial doming of the mask (local doming) which can result in aberrations when a predetermined tolerance level is exceeded.

Various attempts have been made to limit or prevent this disadvantageous thermal behavior, which can affect the shadow mask. In addition, various measures have been suggested to limit excessive heating of the mask.

U.S. Pat. No. 3,887,828 suggests arranging a thin layer of metallic aluminum and a manganese dioxide layer onto a metallic apertured mask. The aluminum layer is in contact with the apertured mask at the aperture edges only. It should have electrically conducting and electron-absorbing properties. Another layer of graphite, nickel oxide or nickel iron is coated on top of the aluminum layer.

In the '828 patent, the porosity of the manganese oxide layer is said to originate substantially from the individually arranged particles, which layer forms a sandwich-like structure with the thin aluminum layer. Due to this layered structure, heat generated by the impact of electrons is intended to be kept away from the metallic apertured mask and emitted in the opposite direction.

This solution has various drawbacks. It was found that keeping the generated heat away from the apertured mask is not feasible, because the majority of heat is not generated within the aluminum layer and the overlying graphite layer, but in the apertured mask. The electron-reflecting, electron-absorbing and heat-emitting properties of the aluminum layer are too low. The heat insulating sandwich structure arranged on top of the apertured mask can emit heat, but only with difficulty.

Furthermore, there may have been suggestions to provide the surface of an apertured mask with a heat-insulating layer and to coat a cover layer containing heavy-metals on top thereof. The heat-insulating layer consists of porous solids which are coated on the metallic apertured mask together with a binder. However, the technological input of coating two layers, namely, one heat-insulating layer and one cover layer containing heavy-metals arranged on top thereof, is relatively high.

SUMMARY OF THE INVENTION

The invention is based on the object of providing an insulating layer which, due to its heat-insulating effect, largely prevents heat transfer to the apertured mask. Consequently, the mask can exhibit decreased doming effects without coating an additional cover layer on the mask.

One embodiment of the invention includes a shadow mask for fixing in a frame and to be arranged in front of a screen of a color picture tube. The shadow mask can include an apertured mask comprising predominantly iron metal and having a cathode-side surface. An insulating layer comprising bound porous inorganic particles containing heavy metals, heavy metal compounds, or combinations thereof can be adjacent to the cathode-side surface of the apertured mask.

Another embodiment of the invention includes a shadow mask for fixing in a frame and to be arranged in front of a screen of a picture tube. The shadow mask can include an apertured mask comprising predominantly iron metal and having a cathode-side surface. An insulating layer comprising a coating having bound porous inorganic particles can be adjacent to the cathode-side surface of the mask.

Yet another embodiment of the invention includes a process for producing a shadow mask wherein the process can comprise: contacting porous particles with a binder, the binder comprising dispersed heavy metals or heavy metal compounds; mixing the porous particles and the binder; and fixing the heavy metal or the heavy metal compounds to the porous particles.

The invention will now be described in more detail and with reference to the figures, examples and specific embodiments.

BRIEF DESCRIPTION OF THE DRAWINGS

FIG. 1 illustrates a color picture tube in sectional view.

FIG. 2 illustrates a shadow mask in top view.

DETAILED DESCRIPTION

According to an aspect of the invention, an apertured part of a shadow mask can be provided with a heat-insulating layer comprising particles having a porous structure. The particles having a porous structure can comprise heavy metals and/or heavy metal compounds in their cavities so that an electron-reflecting and absorbing effect is generated directly within the layer. As a result of the insulating effect of the layer, the heat released from the layer tends to be transferred to the interior of the tube rather than to the apertured mask. Because embodiments of the invention do not require a cover layer, the release of heat into the interior of the tube will not be impeded. Consequently, local temperature differences, which may give rise to partial doming of the apertured mask, are largely avoided.

Surprisingly, in other embodiments, it was also found that an insulating layer even without the addition of heavy metal compounds, can result in a notable decrease in doming effects in an apertured mask having the insulating layer.

The heat-insulating layer according to embodiments of the invention can also comprise particles having a porous structure embedded in a binder.

Advantageously, the production of the shadow mask according to embodiments of the invention involves combining particles having a porous structure with heavy metal compounds prior to coating the apertured mask. Consequently, the incorporation of heavy metals and/or heavy metal compounds into the porous structure can be accomplished quite effectively.

The particles having a porous structure can have ion-exchanging properties. The use of water-soluble heavy metal compounds can permit relatively easy incorporation of heavy metal ions into the porous structure and can permit relatively easy exchange with ions, (e.g., alkali ions) which can be present in the porous structure. Advantageously, ion exchangers based on zeolites, intercalated layer compounds selected from the groups of clay minerals or metal phosphates (e.g., cerium phosphate), can be used.

If there are special quality requirements with respect to doming behavior, the porous ion exchangers loaded with heavy metals through ion exchange can additionally be provided with other heavy metal compounds. These additional heavy metal compounds can be optionally be fixed by a subsequent treatment.

Fixing the heavy metals and/or heavy metal compounds can occur in any suitable manner. Exemplary fixing methods include ion exchanging heavy metals or heavy metal compounds, drying, decomposing a heavy metal compound by a heat treatment, converting salt-like heavy metal compounds to oxides, treating with sulfide ions, treating with a hydrogen sulfide or water soluble sulfur compounds, depositing the heavy metals or heavy metal compounds from a gaseous phase, reducing or oxidizing.

In another embodiment of the invention, inorganic particles lacking ion exchanging properties can be provided as the particles having a porous structure. In this embodiment, porous particles made of oxidic, siliceous or phosphatic materials such as metal oxides, zeolites and metal phosphates can be particularly suitable. Among others, silicic acid, zirconium dioxide and titanium dioxide can be suitable as oxidic particles having a porous structure.

In particular, the porous siliceous materials include the vast group of zeolite materials. Particularly suitable are molecular sieves such as natural molecular sieves. Molecular sieves include chabazite, mordenite, erionite, faujasite, and clinoptilolite, as well as the synthetic zeolites A, X, Y, L, B and/or those of the ZSM type. Since there is such a wide variety of zeolite structures, not all types can be mentioned here. Surprisingly, it was found that effective heat insulation of the shadow mask can be achieved even with thin layers coated onto the mask. Likewise, advantageous effects can result when using porous phosphatic solids such as the so-called aluminophosphates, silicoaluminophosphates and metal aluminophosphates which can be produced by synthesis, and can be classified as small, medium and large pore types.

Other suitable porous solids include intercalated clay minerals, layered phosphates and silica gel as well as a variety of other aluminosilicate compounds.

The heavy metal compounds which can be incorporated into the porous structures may be fixed by drying or a high temperature treatment with decomposition. For example, subsequent action of sulfide ions advantageously results in sulfidic heavy metal compounds which, due to their black coloration, can enhance heat dissipation. During production, the pore size of the particles having a porous structure may be varied within a wide range. Depending on the requirements, loading with heavy metals can be accomplished in a highly effective manner.

In particular, crystalline and glassy silicates, phosphates and borates can be provided as binders for the insulating layer. Binders such as water glass and metal phosphates can be used. The binders can exhibit high adhesive properties on the surface of the mask, thereby yielding a mechanically stable coating which can impart additional dimensional stability to the apertured mask.

The layer can be coated by various coating procedures. For example, the coating layer can be sprayed on the surface of the mask. Such coating procedures can be performed inexpensively.

The insulating layer can have a layer thickness between about 10 and about 50 $\mu$m, and can include particles having an average particle size between about 1 and about 10 $\mu$m.

Advantageously, the invention can remarkably improve the doming behavior of a mask (e.g., iron masks), thereby making it possible in many cases to abandon the use of costly Invar for the masks.

FIG. 1 shows a color picture tube consisting of a bulb 1 with a screen 2 and a beam system 7 arranged in the tube neck 5 as its main components. The internal side 3 of the screen 2 has a patterned luminescent layer which, as is known, generates a picture upon electron beam impact. A cone 4 of the bulb 1 forms the funnel-shaped junction between the screen 2 and the tube neck 5. The tube neck 5 ends in a socket 6. The beam system 7 includes multiple cathodes and additional electrodes for generating and controlling the electron beams. By using a mask frame (not depicted in FIG. 1), a shadow mask 8 can be arranged at the interior side 3 of the screen 2. High voltage (25–30 kV operating voltage) is supplied through an anode contact 9.

FIG. 2 illustrates a part of the shadow mask 8 from a top view, herein designated as apertured mask 22. The thickness of the apertured mask 22 generally ranges from about 0.130 to about 0.280 mm within a narrow tolerance. The desired aperture patterns can be etched by chemical means. Forming the shadow mask 8, which is preferred for tube function, can be formed by using deep drawing.

To evaluate the properties of the color picture tubes under electron beam bombardment during operation, the impact behavior of the electron beams is examined. To this end, the most biased areas of the apertured mask 22 are used which are represented by the four measuring points 25, 24, 26 and 27. The beam impact drift caused by heating of the mask under electron beam bombardment is a gauge for tube quality and ultimately, a gauge for the success of any measures to avoid doming in the picture tubes.

EXAMPLE 1

A shadow mask consisting predominantly of iron metal and provided with a layer of black iron oxide, $Fe_3O_4$, is coated on the cathode side with a layer of microporous lead zeolite 4A, $Pb_6[(AlO_2)_{12}(SiO_2)_{12}]$ and water glass. The layer, which has a thickness of from 20 to 50 $\mu$m, is produced by spraying an aqueous dispersion having 100 parts of lead zeolite 4A, intercalated with n-octanol, an average particle size 2 $\mu$m, 50 parts of sodium silicate solution, 5.8 M; Na/Si=0.61:1.0, 200 parts of water, and 0.1 parts of a cationic surfactant.

The lead zeolite 4A was prepared by ion exchange from the structurally related sodium zeolite 4A. The intercalation of n-octanol into the lead zeolite 4A was performed after dehydrating the lead zeolite through the gaseous phase.

EXAMPLE 2

A shadow mask is formed in the same manner as in Example 1. However, lanthanum zeolite 4A, $La_4[(AlO_2)_{12}$ $(SiO_2)_{12}$], prepared by ion exchange from sodium zeolite 4A, is used as a microporous material.

EXAMPLE 3

A shadow mask is formed in the same manner as in Example 1. However, sodium barium zeolite 4A, $Na_6Ba_6$ $[(AlO_2)_{12}(SiO_2)_{12}]$, prepared by ion exchange from sodium zeolite 4A, is used as a microporous material.

EXAMPLE 4

A shadow mask is formed in the same manner as in Example 1. However, sodium lead zeolite 4A having lead sulfide depositions in the pores of the zeolite crystals, is used as a microporous material. The lead sulfide is deposited in the pores by the reaction of lead zeolite 4A with hydrogen sulfide and subsequent neutralization using sodium water glass.

EXAMPLE 5

A shadow mask is formed in the same manner as in Example 1. However, 5 parts of sodium sulfide 9-hydrate, $Na_2S.9H_2O$, is added to the aqueous dispersion.

What is claimed is:

1. A shadow mask for use in a frame and to be arranged in front of a screen of a color picture tube, said shadow mask comprising:

an apertured mask comprising predominantly iron metal and having a cathode-side surface; and an insulating layer comprising bound porous inorganic particles containing heavy metals, heavy metal compounds, or combinations thereof, said insulating layer adjacent to the cathode-side surface of the apertured mask.

2. The shadow mask according to claim 1 wherein the inorganic particles comprise heavy metal oxides, heavy metal sulfides or combinations thereof.

3. The shadow mask of claim 1 wherein the heavy metal compound is selected from the group consisting of barium, lead, tantalum, bismuth, cerium and tungsten compounds.

4. A shadow mask for use in a frame and to be arranged in front of a screen of a picture tube, said shadow mask comprising:

an apertured mask comprising predominantly iron metal and having a cathode-side surface; and an insulating layer comprising a coating comprising bound porous inorganic particles, said insulating layer adjacent to the cathode-side surface of the apertured mask.

5. The shadow mask of claim 4 wherein the inorganic particles comprise ion exchangers.

6. The shadow mask of claim 5 wherein the ion exchangers comprise zeolites or intercalated layer compounds, the intercalated layer compounds selected from the group consisting of clay minerals and metal phosphates.

7. The shadow mask of claim 5 wherein the ion exchangers comprise cerium phosphates.

8. The shadow mask of claim 5 wherein the ion exchangers have been loaded with heavy metal ions, said heavy metal ions selected from the group consisting of barium, lanthanum, cerium, tungsten, lead, and bismuth ions.

9. The shadow mask of claim 4 wherein the inorganic particles lack ion exchanging properties.

10. The shadow mask of claim 4 wherein the inorganic particles are selected from the group consisting of oxidic particles, siliceous particles, phosphatic particles, and mixtures thereof.

11. The shadow mask of claim 4 wherein the inorganic particles comprise a metal oxide, said metal oxide selected from the group consisting of silicon dioxide, magnesium oxide, aluminum oxide, and subgroup element oxides, said subgroup element oxides selected from the group consisting of titanium dioxide and zirconium dioxide.

12. The shadow mask of claim 10 wherein the siliceous particles are selected from the group consisting of zeolites, pillared clays, silica gel, and combinations thereof.

13. The shadow mask according to claim 10 wherein the phosphatic particles are selected from the group consisting of aluminophosphates, silicoaluminophosphates, metal aluminophosphates, and metal phosphates, the metal phosphates comprising zirconium phosphate.

14. The shadow mask of claim 5 wherein the inorganic particles comprise deposits of heavy metal compounds, heavy metals, or combinations thereof.

15. The shadow mask of claim 1 wherein the inorganic particles are selected from the group consisting of a heavy metal chalkogenides and nitrides.

16. The shadow mask of claim 4 further comprising a binder binding the inorganic particles together, the binder selected from the group consisting of siliceous materials, phosphatic materials, and combinations thereof.

17. The shadow mask of claim 4 further comprising a binder binding the inorganic particles together, the binder selected from the group consisting of crystalline metal silicates, glassy metal silicates, metal phosphates, metal borates, glasses and combinations thereof.

18. The shadow mask of claim 4 further comprising a binder binding the inorganic particles together, the binder comprising water glass.

19. A process for producing a shadow mask having an apertured mask predominantly comprising iron and having a cathode-side surface, and an insulating layer comprising bound porous inorganic particles containing at least one of heavy metals and heavy metal compounds, the insulating layer being adjacent to the cathode-side surface of the apertured mask, the process comprising:

contacting inorganic porous particles with a molecular dispersed formulation containing at least one of a heavy metal and a heavy metal compound;

fixing the molecular dispersed formulation to the inorganic porous particles; and mixing the inorganic porous particles and a binder.

20. The process of claim 19 wherein fixing the molecular dispersed formulation comprises ion exchange.

21. The process of claim 19 wherein fixing the molecular dispersed formulation comprises drying.

22. The process of claim 19 wherein fixing the molecular dispersed formulation comprises decomposing the heavy metal compound by a heat treatment.

23. The process of claim 19 wherein fixing the molecular dispersed formulation comprises converting salt-like heavy metal compounds to oxides.

24. The process of claim 19 wherein fixing the molecular dispersed formulation comprises treating with sulfide ions.

25. The process of claim 19 wherein fixing the molecular dispersed formulation comprises treating with hydrogen sulfide and/or a water-soluble sulfur compound, said water-soluble sulfur compound comprising thiourea.

26. The process of claim 19 wherein fixing the molecular dispersed formulation comprises depositing heavy metals from a gaseous phase.

27. The process of claim 19 wherein fixing the molecular dispersed formulation comprises reducing or oxidizing.

* * * * *